US011380247B2

(12) United States Patent
Kim et al.

(10) Patent No.: US 11,380,247 B2
(45) Date of Patent: Jul. 5, 2022

(54) DISPLAY APPARATUS AND METHOD OF CONTROLLING THE SAME

(71) Applicant: SAMSUNG ELECTRONICS CO., LTD., Suwon-si (KR)

(72) Inventors: Dooyoung Kim, Suwon-si (KR); Jaewon Jung, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 0 days.

(21) Appl. No.: 17/109,690

(22) Filed: Dec. 2, 2020

(65) Prior Publication Data

US 2021/0166619 A1 Jun. 3, 2021

(30) Foreign Application Priority Data

Dec. 3, 2019 (KR) ..... 10-2019-0158672

(51) Int. Cl.
*G09G 3/32* (2016.01)
*H05B 45/3725* (2020.01)

(52) U.S. Cl.
CPC ..... *G09G 3/32* (2013.01); *H05B 45/3725* (2020.01)

(58) Field of Classification Search
CPC ..... G09G 3/2088; G09G 3/32; G09G 2320/0693; G09G 2300/026; G06F 3/1446; H05B 47/155; H05B 45/3725; H05B 47/18; H05B 45/30
See application file for complete search history.

(56) References Cited

U.S. PATENT DOCUMENTS

| | | | | |
|---|---|---|---|---|
| 9,905,151 | B2 | 2/2018 | Suzuki et al. | |
| 2011/0109228 | A1* | 5/2011 | Shimomura | H05B 45/37 315/113 |
| 2013/0082609 | A1* | 4/2013 | Williams | H05B 45/54 315/185 R |
| 2016/0188278 | A1 | 6/2016 | Lee et al. | |
| 2016/0224306 | A1 | 8/2016 | Rycyna, III et al. | |
| 2018/0350305 | A1 | 12/2018 | Kim et al. | |

FOREIGN PATENT DOCUMENTS

| | | | |
|---|---|---|---|
| JP | 2016-143561 | A | 8/2016 |
| KR | 10-1545466 | B1 | 8/2015 |
| KR | 10-2016-0079365 | A | 7/2016 |

OTHER PUBLICATIONS

International Search Report (PCT/ISA/210) dated Apr. 1, 2021 by the International Searching Authority in International Application No. PCT/KR2020/017109.

* cited by examiner

*Primary Examiner* — Muhammad N Edun
(74) *Attorney, Agent, or Firm* — Sughrue Mion, PLLC

(57) ABSTRACT

A display apparatus of the disclosure includes a first light emitting diode (LED) module including a first driving assembly; a second LED module including a second driving assembly; a connector configured to connect the first driving assembly and the second driving assembly; and a processor connected to the first driving assembly. The processor may be configured to transmit image data and a control signal to the first driving assembly. The first driving assembly may be configured to operate based on the image data, and to transmit the image data and the control signal to the second driving assembly through the connector.

15 Claims, 14 Drawing Sheets

FIG 12

| T-CON | | CABLE CONNECTION | FIRST LED MODULE | | | | |
|---|---|---|---|---|---|---|---|
| | | | FIRST CONNECTOR | | | SECOND CONNECTOR | |
| 1 | POWER(1) | | 1 | POWER(1) | 0 | DATA_SEL → GND | 1 |
| 2 | POWER(2) | | 2 | POWER(2) | | POWER(2) | 2 |
| ... | | | ... | | | | ... |
| 49 | POWER(3) | | 49 | FLASH_SEL1 →POWER(3) | 1 | FLASH_SEL2 → POWER(4) | 49 |
| 50 | POWER(4) | | 50 | FLASH_SEL2 → POWER(4) | 0 | GND | 50 |
| 51 | POWER(5) | | 51 | FLASH_SEL3 → POWER(5) | 0 | GND | 51 |

DISPLAY APPARATUS AND METHOD OF CONTROLLING THE SAME

CROSS-REFERENCE TO RELATED APPLICATION(S)

This application is based on and claims priority under 35 U.S.C. § 119 to Korean Patent Application No. 10-2019-0158672, filed on Dec. 3, 2019 in the Korean Intellectual Property Office, the disclosure of which is incorporated by reference herein in its entirety.

BACKGROUND

1. Field

The disclosure relates to a display apparatus including a plurality of light emitting diodes (LEDs) and a method of controlling the same.

2. Description of Related Art

A display apparatus may include a non-emissive display panel such as a liquid crystal display (LCD) and an emissive display panel that generates light corresponding to a data signal. In particular, research on a light emitting diode (LED), which is an inorganic light emitting element, is being actively conducted to implement the emissive display panel.

The LED is an element that converts electrical signals into light forms such as infrared and visible rays using the characteristics of compound semiconductors. The LED is not only used in home appliances, remote controls, electronic boards, and various automation devices, but also is increasingly used in small handheld electronic devices and large display apparatuses.

In recent years, research has been conducted on a modular display in which multiple LED modules including a certain number of LEDs are combined into a single device to form a single screen. The modular display is implemented in a collective installation method of digital information display (DID) panels, and has an advantage of not being restricted in implementing a resolution desired by a consumer.

The modular display supplies power and data so that the LEDs provided in each module emit light. In the conventional modular display, a main board or a switching mode power supply (SMPS) for supplying power and data for each module is separately provided.

SUMMARY

Provided are a display apparatus capable of improving power efficiency and operating efficiency of a driving integrated circuit (IC), and controlling a plurality of LED modules by one main board controlling at least two LED modules, and a method of controlling the display apparatus.

Additional aspects of the disclosure will be set forth in part in the description which follows and, in part, will be obvious from the description, or may be learned by practice of the disclosure.

In accordance with an aspect of the disclosure, a display apparatus includes a first light emitting diode (LED) module including a first driving assembly; a second LED module including a second driving assembly; a connector configured to connect the first driving assembly to the second driving assembly; and a processor connected to the first driving assembly, wherein the processor is configured to transmit image data and a control signal to the first driving assembly, and wherein the first driving assembly is configured to operate based on the image data, and to transmit the image data and the control signal to the second driving assembly through the connector.

The second driving assembly may be configured to operate based on the image data received through the connector, and to transmit a feedback signal based on the control signal to the processor through the connector.

The control signal may include a signal for selecting the second LED module, and the processor may be configured to transmit the control signal for selecting the second LED module through the connector.

Each of the first driving assembly and the second driving assembly may include a respective memory configured to store respective calibration data for a plurality of LEDs.

The second driving assembly may be configured to transmit the calibration data in a feedback signal based on the control signal.

The second driving assembly may include a first connector configured to be connected to the first driving assembly through a first cable; and a second connector configured to be connected to a third driving assembly through a second cable.

The second driving assembly may be configured to transmit a feedback signal based on the control signal to the processor through the connector, and the second driving assembly may be configured to change the feedback signal based on a connection state of the second connector and the second cable.

The first connector may include a first plurality of pins and the second connector may include a second plurality of pins, wherein at least one of the first plurality of pins is in electrical contact with at least one of the second plurality of pins; and the processor may be configured to transmit the control signal based on at least three or more pins among the first plurality of pins and the second plurality of pins.

The second connector may include at least one pin connected to a ground.

The first driving assembly and the second driving assembly may each include a respective plurality of driving integrated circuits (ICs), each of the plurality of driving ICs being configured to control a predetermined number of respective LEDs; and the plurality of driving ICs may be configured to operate based on the image data.

Each of the first LED module and the second LED module may include a respective switching mode power supply (SMPS) configured to supply power to the first driving assembly and the second driving assembly, respectively.

In accordance with an aspect of the disclosure, a method of controlling a display apparatus, the display apparatus including a first light emitting diode (LED) module including a first driving assembly, a second LED module including a second driving assembly, a cable configured to connect the first driving assembly to the second driving assembly, and a processor connected to the first driving assembly, the method includes transmitting, by the processor, image data and a control signal to the first driving assembly; transmitting, by the first driving assembly, the image data and the control signal to the second driving assembly through the cable; and transmitting, by the second driving assembly, a feedback signal based on the control signal to the first driving assembly through the cable.

The control signal may include a signal for selecting the second driving assembly.

Each of the first driving assembly and the second driving assembly may include a respective memory configured to store calibration data for a plurality of LEDs; and the transmitting by the second driving assembly may include transmitting the calibration data in the feedback signal based on the control signal.

The second driving assembly may include a first connector configured to be connected to the cable; and a second connector configured to be connected to a third driving assembly through an additional cable, and the transmitting by the first driving assembly may include transmitting the image data and the control signal through the first connector.

The transmitting by the second driving assembly may include changing the control signal based on a connection state of the second connector.

The cable may include a plurality of pins in electrical contact with the first connector of the second driving assembly; and the transmitting by the processor may include transmitting the control signal to the third driving assembly using at least three pins among the plurality of pins.

The second connector may have at least one pin connected to a ground, and the transmitting by the first driving assembly may include transmitting a ground signal through the at least one pin to the second driving assembly.

BRIEF DESCRIPTION OF THE DRAWINGS

The above and other aspects, features, and advantages of certain embodiments of the disclosure will be more apparent from the following description taken in conjunction with the accompanying drawings, in which:

FIGS. 10, 11, and 12 are views of a pin map for describing a second control signal.

DETAILED DESCRIPTION

Figure 1:
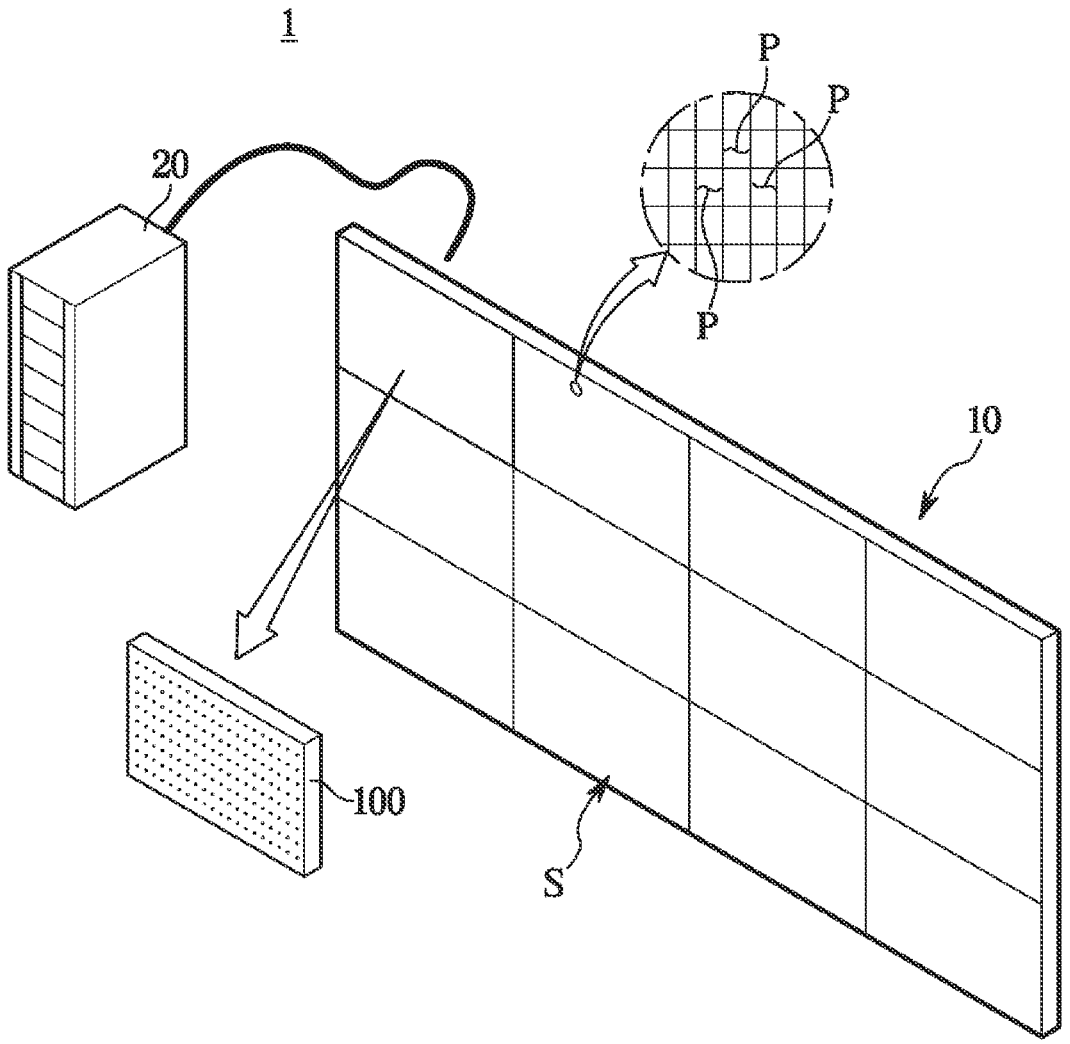
FIG. 1 is an external view illustrating a display system according to an embodiment.

Like reference numerals refer to like elements throughout the specification. Not all elements of embodiments of the disclosure will be described, and the description of what are commonly known in the art or what overlap each other in example embodiments will be omitted. The terms as used throughout the specification, such as "~part," "~module," "~member," "~block," etc., may be implemented in software and/or hardware, and a plurality of "~parts," "~modules," "~members," or "~blocks" may be implemented in a single element, or a single "~part," "~module," "~member," or "~block" may include a plurality of elements.

It will be further understood that the term "connect" and its derivatives refer both to direct and indirect connection, and the indirect connection includes a connection over a wireless communication network.

The terms "include (or including)" and "comprise (or comprising)" are inclusive or open-ended and do not exclude additional, unrecited elements or method steps, unless otherwise mentioned. It will be further understood that the term "contact" and its derivatives refer both to when a member is in contact with another member and when another member exists between the two members.

Further, when it is stated that a layer is "on" another layer or substrate, the layer may be directly on another layer or substrate or a third layer may be disposed therebetween.

It will be understood that, although the terms first, second, third, etc., may be used herein to describe various elements, components, regions, layers and/or sections, these elements, components, regions, layers and/or sections should not be limited by these terms. These terms are only used to distinguish one element, component, region, layer or section from another region, layer or section.

It is to be understood that the singular forms "a," "an," and "the" include plural references unless the context clearly dictates otherwise.

Reference numerals used for method steps are merely used for convenience of explanation, but not to limit an order of the steps. Thus, unless the context clearly dictates otherwise, the written order may be practiced otherwise.

Hereinafter, an operation principle and embodiments of the disclosure will be described with reference to accompanying drawings.

Figure 2:
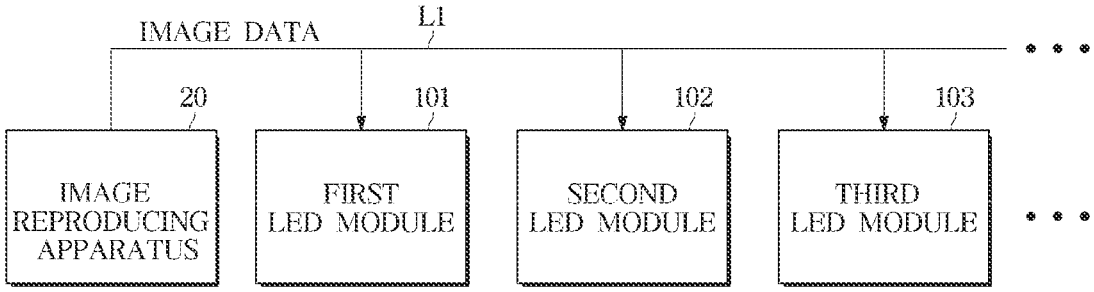
FIG. 2 is a view illustrating a schematic arrangement and signal flows in a display system according to an embodiment.

FIG. 1 is an external view illustrating a display system according to an embodiment, and FIG. 2 is a view illustrating a schematic arrangement and signal flows in a display system according to an embodiment.

Referring to FIGS. 1 and 2, a display system 1 may include a display apparatus 10 that visually presents an image and an image reproducing apparatus 20 that provides image data to the display apparatus 10.

The display system 1 may be used as a big screen in theaters, as a general display apparatus, such as in televisions (TVs) and monitors, or for a large billboard. The display system 1 may be installed outdoors, e.g., on the rooftop of a building or at a bus stop. However, the display system 1 may be installed indoors, e.g., at subway stations, shopping malls, theaters, offices, stores, etc.

The display apparatus 10 may include a plurality of light emitting diode (LED) modules 100. Each LED module 100 may include LEDs to provide a particular resolution. When a relatively large pitch size is provided between the LEDs, the display apparatus 10 may be used for an information transferring device, such as a large billboard. On the contrary, when a relatively small pitch size, such as on the scale of micrometers (μm), is provided between the LEDs, the display apparatus 10 may be used for a high resolution screen in a theater as well as TVs.

The plurality of LED modules 100 may be arranged in rows and columns. In other words, the LED modules 100 may be arranged in the form of a matrix, for example, in a 4×3 matrix as shown in FIG. 1. However, the display apparatus 1 does not necessarily include only 12 LED modules 100, and it is sufficient if two or more LED modules are connected in series.

The plurality of LED modules 100 arranged in a matrix may be integrated into a single screen S. The integrated LED modules 100 may be controlled to display an image.

Each LED in the plurality of LED modules 100 may correspond to a unit pixel P, and an image may be formed by a combination of light emitted from the plurality of pixels P.

For example, the plurality of pixels P may emit light with various brightnesses and colors, and the light emitted by the plurality of pixels P may be combined into an image that may be perceived by a viewer.

The screen S may include a variable number of LEDs corresponding to various resolutions. For example, to have 4K resolution according to Digital Cinema Initiatives (DCI), the screen S may include 4096×2160 LEDs. In another example, to have 4K ultra high definition (UHD) resolution according to the International Telecommunication Union (ITU), the screen S may include 3840×2160 LEDs. Particularly, when each unit pixel P of the screen S having the 4K resolution includes a red LED, a blue LED, and a green LED, the number of LEDs corresponding to the 4K resolution may be 4096×2160×3 or 3840×2160×3. When each LED corresponding to the unit pixel P is a single LED chip, which is an encapsulation of red, blue, and green LEDs, the number of LEDs corresponding to the 4K resolution may be 4096×2160 or 3840×2160.

The image reproducing apparatus 20 may store content, such as a video, or may receive the content from an external content source (e.g., a video streaming service server). For example, the image reproducing apparatus 20 may store a file of content data in a storage, or receive content data from the external content source in real time.

The image reproducing apparatus 20 may decode the stored or received content data into image frame data (hereinafter, image data). For example, a broadcast signal or content data may be received or stored in a compressed format according to various video compression standards, such as Moving Picture Experts Group (MPEG), High Efficiency Video Coding (HEVC), etc. The image reproducing apparatus 20 may restore the image data representing each image frame from the compressed content data.

The image reproducing apparatus 20 may transmit the restored image data to the display apparatus 10.

Referring to FIG. 2, there may be image data lines, such as image data line L1, between the image reproducing apparatus 20 and the plurality of LED modules 101, 102, and 103, and the image reproducing apparatus 20 may transmit the image data to the plurality of LED modules 101, 102, and 103 through the image data lines. FIG. 2 illustrates a single image data line L1.

Upon reception of the image data, the plurality of LED modules 101, 102, and 103 may each display a portion of an image to be displayed on the entire screen S. Particularly, each of the plurality of LED modules 101, 102, and 103 may occupy a certain area on the screen S and output a portion of the entire image corresponding to where the LED module is arranged.

The image data may be divided into frames, and the display apparatus 1 performs timing control so that a plurality of LED modules 101, 102, and 103 divide and display a single frame. A detailed description of this will be described later with reference to the following drawings.

Figure 3:
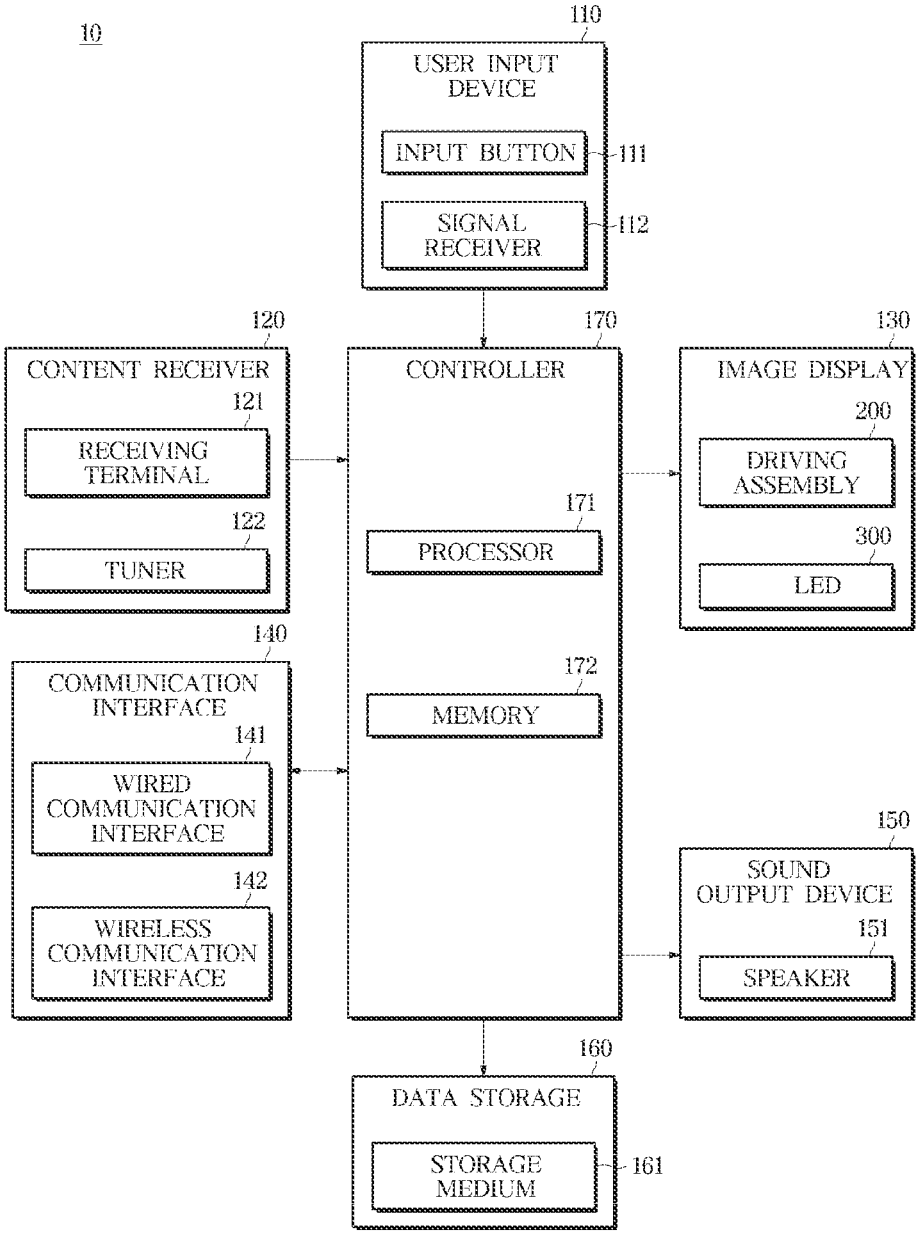
FIG. 3 is a control block diagram of a display apparatus according to an embodiment.

FIG. 3 is a control block diagram of a display apparatus according to an embodiment.

Referring to FIG. 3, the display apparatus 10 may include a user input device 110 for receiving a user input from the user, a content receiver 120 for receiving a video signal and/or an audio signal (or collectively, an image signal) from content sources, an image display 130 for displaying an image, a communication interface 140 for communicating with external devices, a sound output device 150 for outputting sound, a data storage 160 for storing various programs and data, and a controller 170 for controlling operations of the display apparatus 10.

The user input device 110 may include an input button 111 for receiving a user input, and a signal receiver 112 for receiving a remote control signal from a remote controller. For example, the user input device 110 may include a power button for soft turn-on (operation start) or soft turn-off (operation stop) of the display apparatus 10, a sound control button to control sound volume output by the display apparatus 10, a source selection button to select a content source, etc.

The input button 111 may receive a user input, generate an electric signal corresponding to the user input, and transmit the electric signal to the controller 170. The input button 111 may be implemented with various input devices such as a push switch, a touch switch, a dial, a slide switch, a toggle switch, etc.

The remote controller may be provided separately from the display apparatus 10, and may receive a user input and transmit a radio signal corresponding to the user input to the display apparatus 10. The signal receiver 112 may receive a radio signal corresponding to a user input from the remote controller, generate an electric signal corresponding to the user input, and transmit the electric signal to the controller 170.

The content receiver 120 may include receiving terminal 121 and a tuner 122 for receiving an image signal including a video signal and/or an audio signal from the content sources. According to one or more embodiments, the content receiver 120 may include a plurality of receiving terminals 121.

The receiving terminals 121 may receive a video signal and an audio signal from the content sources through a cable. For example, the receiving terminals 121 may include a component (YPbPr/RGB) terminal, a composite video blacking and sync (CVBS) terminal, an audio terminal, a high definition multimedia interface (HDMI) terminal, a universal serial bus (USB) terminal, etc.

The tuner 122 may receive broadcast signals through an antenna or a cable, and extract a broadcast signal corresponding to a channel selected by the user among the received broadcast signals. For example, the tuner 122 may pass a broadcast signal having a frequency corresponding to a channel selected by the user among the plurality of broadcast signals received through the antenna or the cable, and block other broadcast signals having different frequencies.

As such, the content receiver 120 may receive an image signal from the content sources through the receiving terminal 121 and/or the tuner 122, and transmit the image signal to the controller 170. The controller 170 may analyze/process the image signal and then convert the image signal to image data, as will be described later.

The image display 130 may include a driving assembly 200 for converting image data to an analog signal, and the plurality of LEDs 300 driven by the driving assembly 200. The image display 130 may include, for example, an LED module 100.

As described above in FIGS. 1 to 2, the display apparatus 10 is divided into the plurality of LED modules 100. Each LED module 100 may include the driving assembly 200 for driving the plurality of LEDs 300 provided in the LED module 100.

The driving assembly 200 may include a preset number of driving ICs, for example, driving ICs 211 to 218 (see FIG. 5) for driving 16*30 LEDs 300. The driving assembly 200 includes the plurality of driving ICs 211 to 218, and further includes various configurations, such as a power assembly for supplying power to the driving ICs 211 to 218, connectors 220 and 230 for transmitting control signals and image data transmitted from the controller 170. A detailed description thereof will be described later through other drawings.

The communication interface 140 may exchange data with external devices other than the display device 10. For example, the communication interface 140 may exchange data with a user equipment or other electronic devices.

The wired communication interface 141 may access a wired communication network and communicate with an external device over the wired communication network. For example, the wired communication interface 141 may access a wired communication network through Ethernet, the IEEE 802.3 technology standard, or the like and receive data from external devices over the wired communication network.

The wireless communication interface 142 may communicate wirelessly with a base station or an access point (AP), and access the wired communication network via the base station or the AP. The wireless communication interface 142 may communicate with external devices connected to the wired communication network via the base station or the AP. For example, the wireless communication interface 142 may use Wi-Fi™, the IEEE 802.11 technology standard, or the like to communicate with an AP, or use code divisional multiple access (CDMA), wideband code division multiple access (WCDMA), Global Systems for Mobile communications (GSM), Long Term Evolution (LTE), WiBro, etc., to communicate with a base station. The wireless communication interface 142 may receive data from the external devices via the base station or the AP.

In addition, the wireless communication interface 142 may communicate directly with the external device, such as a UE. For example, the wireless communication interface 142 may use Wi-Fi™, Bluetooth™, which is the IEEE 802.15.1 technology standard, ZigBee™, which is the IEEE 802.15.4 technology standard, etc., to wirelessly receive data directly from the external device.

The sound output device 150 may include a speaker 151 for outputting sound in an audible signal or sound waves.

The speaker 151 may convert an analog sound signal amplified by an amplifier to a sound or sound waves. For example, the speaker 151 may include a thin film that vibrates according to an electric sound signal, and the vibration of the thin film may generate sound waves.

The data storage 160 may include a storage medium for storing a program and data for controlling the operation of the display device 10. The program may include a plurality of instructions containing a code made by a compiler or a code executable by an interpreter, which when executed by a processor of the display device, control the display to device to perform a particular function, and the data may be processed according to the plurality of instructions included in the program.

The storage medium 161 may store content data in a file format. For example, the storage medium 161 may store the content data in the form of "*.mpg", "*.avi", "*.asf", or "*.mp4" file, and provide the content data to the controller 170 in response to a readout instruction from the controller 170.

For example, the storage medium 161 may store an image signal input from the content receiver 120 and/or the communication interface 140, and provide the stored image signal for the controller 170 to process image data. In another example, the storage medium 161 may receive and store the image data processed by the controller 170.

The storage medium 161 may store the program and/or data electrically, magnetically, or optically. For example, the storage medium 161 may include a solid state drive (SSD), a hard disc drive (HDD), an optical disc drive (ODD), or the like.

The controller 170 may include one or more memories 172 for memorizing/storing a program/data, and one or more processors 171 for processing the data according to the program. The controller 170 may include hardware, such as the memory 172 and the processor 160, and software, such as the program and/or data memorized/stored in the memory 171 and/or the data storage 160.

The processor 171 may process the data stored in the memory 172 according to programs (or a series of programs). For example, the processor 171 may process the user input, the image data, the communication data, the stored data, etc., according to the program stored in the memory 172. Furthermore, the processor 171 may generate a control signal to control at least one of the image display 130, the communicator 140, or the data storage 160 based on a result of processing the data.

Particularly, the processor 171 may perform data processing on the image signal and generates the control signal for driving the LED module 100. In addition, the processor 171 may perform timing control so that each LED module 100 divides and displays the single frame. For each of the above-described operations, the number of processors 171 may be provided in a single or in plural.

In addition, the processor 171 may transmit the control signal and the image data to the driving assembly 200.

Particularly, the image data transmitted by the processor 171 may be transmitted to the driving assembly 200, and the plurality of driving ICs 211 to 218 provided in the driving assembly 200 may operate based on the image data. The plurality of driving ICs 211 to 218 may sequentially transmit image data and control signals through a cascade method.

The processor 171 may transmit a control signal for controlling the driving assembly 200. According to the control signal, the driving assembly 200 may perform various operations other than displaying the image.

As an example, the processor 171 may transmit a control signal (hereinafter, referred to as a first control signal) for instructing the driving assembly 200 to transmit calibration data stored in the memory 172 of the driving assembly 200. The driving assembly 200 may then transmit the calibration data stored in the memory 172 back to the processor 171 based on the first control signal, and this signal is referred to as a feedback signal.

Figure 5:
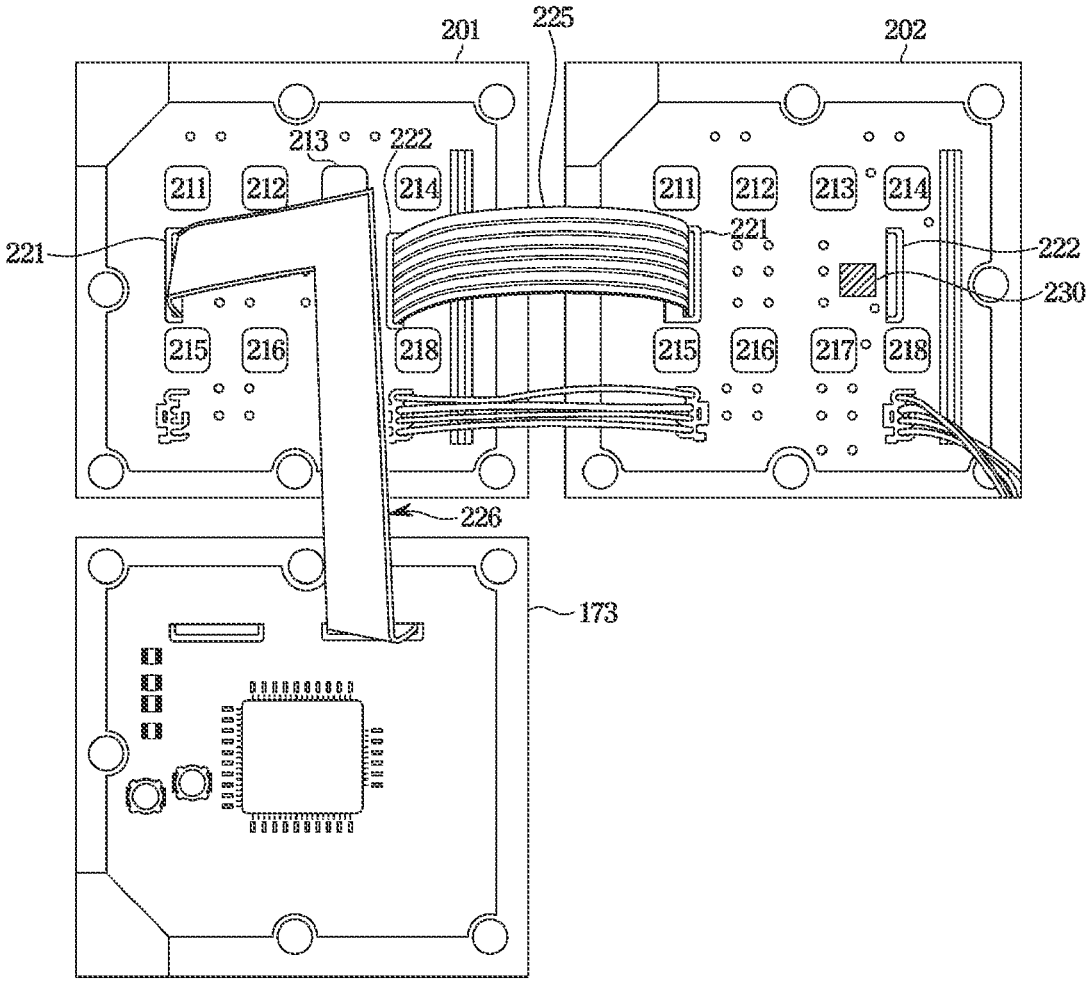
FIG. 5 is a view schematically illustrating a driving assembly of two adjacent LED modules.

As another example, the processor 171 may transmit a control signal (a second control signal) for selecting whether to transmit the image data to another driving assembly 200 connected through the cable 225 by the driving assembly 200 (see, e.g., FIG. 5). That is, the driving assembly 200 may select whether to transmit the image data to another driving assembly 200 connected by the cable 225 or to transmit the feedback signal to the processor 171 based on the second control signal.

A detailed description of this will be described later through other drawings.

The memory 172 may store a program and data for controlling the components included in the display device 10. The memory 172 may include a non-volatile memory, such as a Read Only Memory (ROM), a flash memory, and/or the like, which may store data for a long period, and a volatile memory, such as a static random access memory (SRAM), a dynamic RAM (DRAM), or the like, which may temporarily store data.

The memory 172 may store calibration data. The calibration data may be derived as a result of an inspection performed in a production stage of the LED module 100. Since the LEDs 300 have different characteristics even on the same wafer, the characteristics of RGB may be different for each production lot. Manufacturers may perform calibration so that the LED modules produced have the same product specifications. A characteristic value of the LED module 100 by calibration, that is, the calibration data may be stored in the memory 172.

The memory 172 may be present in a chip integrally with the processor 171, or may be provided in each of the plurality of driving assemblies 200. Hereinafter, the memory provided in the driving assembly 200 will be described as another drawing.

The control block diagram of FIG. 3 is illustrated to describe the function of each component, and does not necessarily show a position of each component. For example, the memory 172 may be provided as a flash memory in the driving assembly 200 that drives the LED module 100. In addition, each LED module 100 may each include the memory 172 storing its own calibration data.

Figure 4:
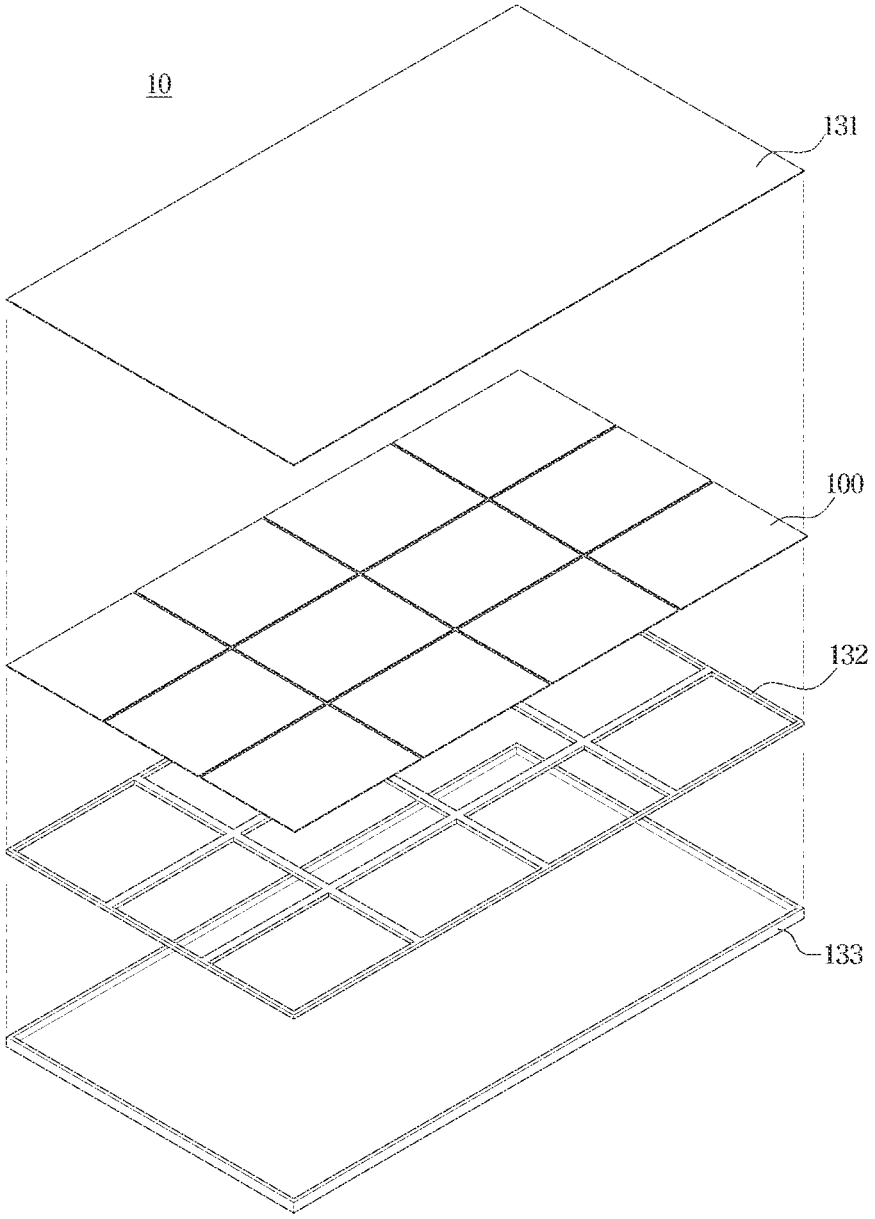
FIG. 4 is an exploded view of a main configuration of a display apparatus.

FIG. 4 is an exploded view of a main configuration of a display apparatus, and FIG. 5 is a view schematically illustrating a driving assembly of two adjacent LED modules.

Referring to FIG. 4, the display apparatus 10 may include a cover glass 131, the plurality of LED modules 100, a frame 132 supporting the plurality of LED modules 100, and a rear cover 133 covering a rear surface of the frame 132.

As described above, the plurality of LED modules 100 may be provided in various M*N matrix in addition to the 4*3 matrix.

The cover glass 131 for protecting and supporting the LED module 100 may be attached to the front surface of the plurality of LED modules 100. An optical film for improving optical performance may be provided between the cover glass 131 and the plurality of LED modules 100. As the optical film, a circular polarizing film, a linear polarizing film, a retardation film, an AG/LR/AR/HC film, a Neutral Density (ND) film, etc., which are used to improve image quality in organic light emitting diodes (OLEDs) or liquid crystal displays (LCDs), may be used.

The plurality of LED modules 100 may be installed on the frame 132 through various known methods, such as magnetic force using a magnet or a mechanical fitting structure.

The rear cover 133 may form a rear surface of the display apparatus 1.

The display apparatus 10 may include a driving circuit board for controlling the plurality of LED modules 100. The display apparatus 10 may be provided with the driving assembly 200 (see, e.g., FIG. 5) to correspond to each LED module 100. The driving assembly 200 may be provided on the rear surface of the LED module 100.

FIG. 5 is a view schematically illustrating a driving assembly of two adjacent LED modules.

As described above in FIGS. 1 and 2, the display apparatus 10 may include the plurality of LED modules 100. The plurality of LED modules 100 are manufactured to include the same configuration. Therefore, each LED module 100 may be connected to a different position, and for this purpose, each LED module 100 has the driving assembly 200 including the same configuration.

Figure 6:
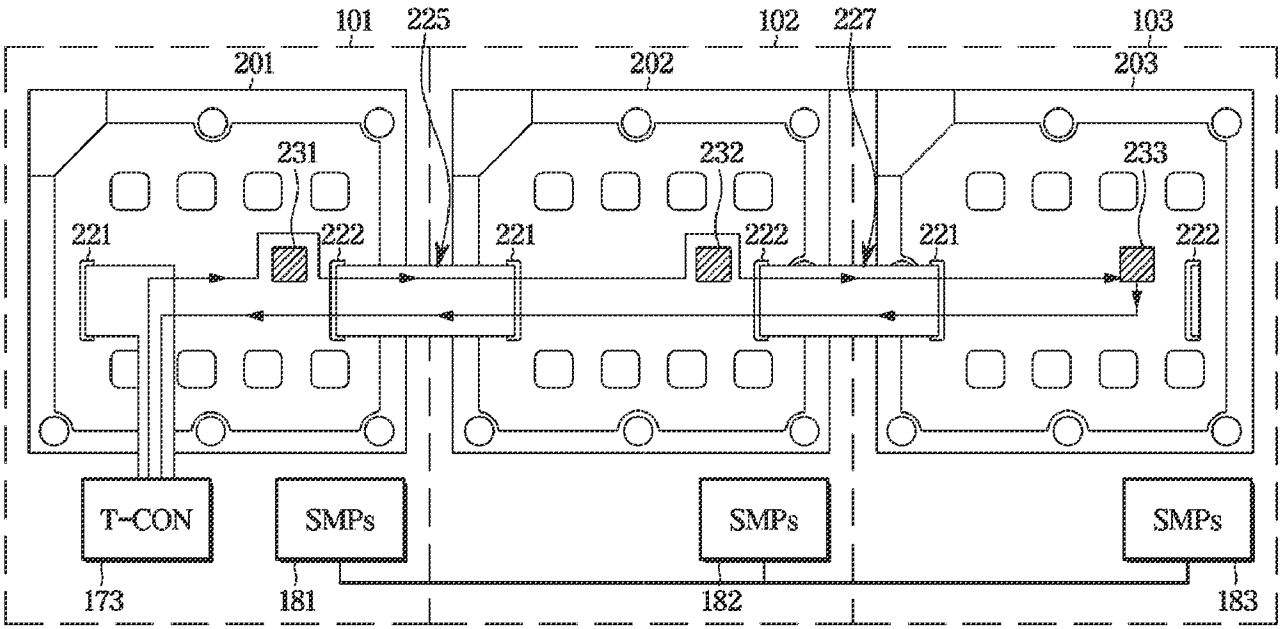
FIG. 6 is a view for describing a driving connection state included in three LED modules according to an embodiment.

Referring to FIGS. 5 and 6, two adjacent LED modules among the plurality of LED modules 100, for example, a first LED module 101 and a second LED module 102, respectively, have the driving assembly 200 including the same configuration. For convenience of explanation, hereinafter, the same two driving assemblies 200 are expressed as a first driving assembly 201 and a second driving assembly 202.

The first driving assembly 201 and the second driving assembly 202 may include the plurality of driving ICs 211 to 218, a first connector 221, a second connector 222, and a memory 230 on a PCB substrate.

Particularly, the plurality of driving ICs 211 to 218 are elements that each drive a preset number of LEDs 300 to emit light. For example, the first driving IC 201 may drive 16*3 LEDs 300 corresponding to 16 pixels. In FIG. 5, it is illustrated that the first driving assembly 201 includes eight driving ICs 211 to 218, but may include eight or more driving ICs depending on the number of LEDs 300 provided in the LED module 100.

The first connector 221 of the second driving assembly 202 and the second connector 222 of the first driving assembly 201 may be connected by a cable 225.

For example, the cable 225 may be provided with 51 pins, and the cable 225 may transmit a first control signal, a second control signal, and image data based on an allocated pin map.

Particularly, the first connector 221 of the first driving assembly 201 may be connected to a timing controller 173. The timing controller 173 is a type of the processor 171 and may control the driving ICs 211 to 218 so that the plurality of LEDs 300 can output frame images.

In the conventional LED modules 100, the timing controller 173 is provided for each LED module 100. However, in the disclosed display apparatus 10, the first LED module 101 is connected to the timing controller 173, and the first driving assembly 201 and the second driving assembly 202 are connected to each other by the cable 225. That is, the disclosed display apparatus 10 does not need to provide a separate timing controller 173 for each LED module 100.

The first control signal, the second control signal, and the image data generated by the timing controller 173 may be transmitted to the first connector 221 of the first driving assembly 201 through another cable 226, and the first driving assembly 201 may transmit the control signal and the image data to the second driving assembly 202 through the cable 225 connected to the second connector 222. The driving ICs 211 to 218 of the second driving assembly 202 may be driven based on the image data.

Meanwhile, the timing controller 173 does not necessarily need to be connected to the first driving assembly 201 through an additional cable 226, and may transmit the first control signal, the second control signal, and image data to the first driving assembly 201 in various methods. That is, the disclosed display apparatus 10 is sufficient if the first LED module 101 and the second LED module 102 transmit the control signals and the image data through the cable 225.

Each of the first driving assembly 201 and the second driving assembly 202 may include the memory 230. The memory 230 may store the calibration data, and may be provided as the non-volatile memory, for example the flash memory. The calibration data reflects different RGB characteristics at the time each LED module 100 was manufactured, and is stored for a certain quality of the output image. Accordingly, the calibration data may be different for each LED module 100.

When the timing controller 173 transmits the first control signal to the first driving assembly 201 for selecting the second driving assembly 202, the first driving assembly 201 may then transmit the first control signal to the second driving assembly 202. According to the first control signal, the second driving assembly 202 may transmit the calibration data of the second LED module 102 stored in the memory 230 to the first driving assembly 201 through the cable 225. In this way, the signal transmitted by the first driving assembly 202 to the timing controller 173 and the signal transmitted by the second driving assembly 202 to the first driving assembly 201 through the cable 225 are referred to as feedback signals. The timing controller 173 may receive the calibration data of the second LED module 102 through the first driving assembly 201.

The disclosed display apparatus 10 does not need to provide the timing controller 173 for each LED module 100, and may individually control each LED module 100 by allocating the first control signal to the pin map of the cable 225.

Meanwhile, the first driving assembly 201 and the second driving assembly 202 may further include various configurations in addition to the above-described configurations.

FIG. 6 is a view for describing a driving connection state included in three LED modules according to an embodiment. Description of the overlapping items described in FIG. 5 will be omitted.

Referring to FIG. 6, the display apparatus 10 may include three LED modules 101, 102, 103. The first LED module 101 may include the first driving assembly 201, the second LED module 102 may include the second driving assembly 202, and the third LED module 103 may include a third driving assembly 203.

The first driving assembly 201 may be connected to the timing controller 173 through the first connector 221. The first cable 225 is inserted into the second connector 222 of the first driving assembly 201. The second driving assembly 202 may be connected to the first cable 225 through the first connector 221. The second cable 227 may be inserted into the second connector 222 of the second driving assembly 202. The third driving assembly 203 may be connected to the second cable 227 through the first connector 221. Through this, the first driving assembly 201 may transmit the first control signal, the second control signal, and the image data of the timing controller 173 to the third driving assembly 203, and the third driving assembly 203 may transmit the feedback signal to the timing controller 173.

The timing controller 173 may collect the calibration data for the first LED module 101, calibration data for the second LED module 102, and calibration data for the third LED module 103 before outputting the image.

The timing controller 173 may transmit the first control signal for selecting the first driving assembly 201, and may receive the calibration data stored in the first memory 231 of the first driving assembly 201.

The timing controller 173 may transmit the first control signal for selecting the second driving assembly 201 to the first driving assembly 201. In this case, the first driving assembly 201 may transmit the first control signal to the second driving assembly 202 through the first cable 225. The second driving assembly 202 may generate the feedback signal including the calibration data stored in the second memory 232 based on the first control signal. The second driving assembly 202 may transmit the feedback signal to the first driving assembly 201. The timing controller 173 may receive the calibration data transmitted by the second driving assembly 202 from the first driving assembly 201.

The timing controller 173 may transmit the first control signal for selecting the third driving assembly 201 to the first driving assembly 201. The first driving assembly 201 may transmit the first control signal to the second driving assembly 202 through the first cable 225. The second driving assembly 202 may transmit the first control signal to the third driving assembly 203 through the second cable 227. The third driving assembly 203 may generate the feedback signal including calibration data stored in the third memory 233 based on the first control signal. The third driving assembly 203 may transmit the feedback signal to the second driving assembly 202. The second driving assembly 202 may transmit the received feedback signal to the first driving assembly 201 through the first cable 225. The first driving assembly 201 may transmit the feedback signal to the timing controller 173, and the timing controller 173 may receive the calibration data included in the feedback signal.

Through this, the timing controller 173 may selectively receive the necessary calibration data from the plurality of LED modules 101, 102, and 103.

Meanwhile, each of the first LED module 101, the second LED module 102, and the third LED module 103 may include a switching mode power supply (SMPS) 181, 182, and 183 respectively that supplies power to operate each component of the driving assembly 200 and the LED 300. Particularly, a first SMPS 181, a second SMPS 182, and a third SMPS 183 may be connected to supply constant power through wiring without separately providing the connector 220 of the driving assembly 200.

Figure 7:
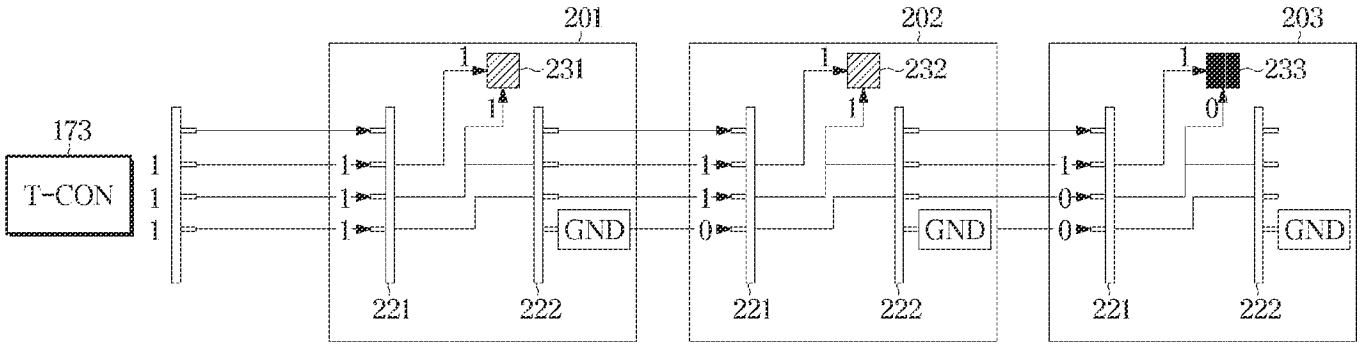
FIGS. 7 to 9 are views for describing an embodiment of a first control signal for selecting an LED module.
Figure 8:
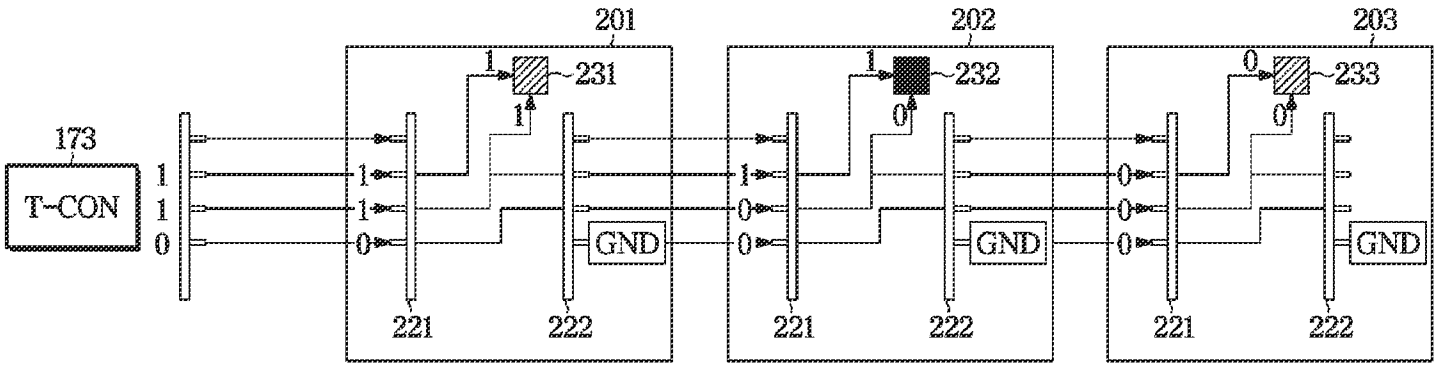
Figure 9:
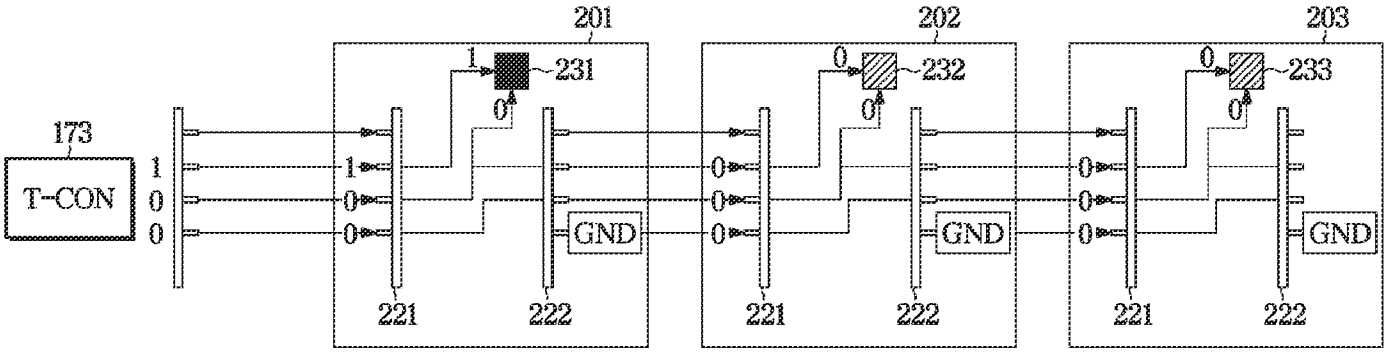

FIGS. 7 to 9 are views for describing an embodiment of a first control signal for selecting an LED module. It will be described together below in order to avoid redundant description.

The timing controller 173 may transmit the first control signal for selecting the driving assembly 200 through 3 pins allocated among 51 pins.

Referring to FIG. 7, in order to select the third driving assembly 203, the timing controller 173 may transmit a first control signal of 1, 1, and 1 through the 3 pins of 51 pins.

The first connector 221 of the first driving assembly 201 may receive 1, 1, and 1. A third pin of the 3 pins in the second connector 222 may be connected to a ground. In addition, a second pin of the first connector 221 may be connected to a first pin of the second connector 222 on the PCB board.

The first driving assembly 201 may pass the first control signal based on the first and second signals being 1 and 1. In other words, as shown in FIG. 7, the first and second signals being 1 and 1 cause the first driving assembly 201 not to transmit any calibration data.

Since the third pin of the second connector 222 of the first driving assembly 201 is connected to the ground, the second driving assembly 202 may receive 1, 1, and 0 from the first driving assembly 201 through the first connector 221.

In the second connector 222 of the second driving assembly 202, the second pin of the 3 pins may be connected to the first connector 221 and the third pin may be connected to the ground. Like the first driving assembly 201, the second driving assembly 202 may pass the first control signal based on the first and second signals being 1 and 1 and may not transmit any calibration data. However, the control signal 1, 0, and 0 may be transmitted to the third driving assembly 203.

The third driving assembly 203 may transmit the calibration data stored in the memory 230 to the timing controller 173 based on the first and second signals being 1 and 0.

Meanwhile, the third pin of the 3 pins in the second connector 222 of the third driving assembly 203 may also be connected to the ground.

Referring to FIG. 8, in order to select the second driving assembly 202, the timing controller 173 may transmit the first control signal of 1, 1, and 0 through the 3 pins of the 51 pins.

The first connector 221 of the first driving assembly 201 may receive 1, 1, and 0. Based on the first and second signals being 1 and 1, the first driving assembly 201 may pass the first control signal and may not transmit any calibration data.

Like FIG. 7, in the second connector 222 of the first driving assembly 201, the second pin of the 3 pins may be connected to the first connector 221 of the first driving assembly 202, and the third pin may be connected to the ground. Therefore, the second connector 222 of the first driving assembly 201 may transmit 1, 0, and 0 to the second driving assembly 202.

The second driving assembly 202 may receive 1, 0, and 0 from the first driving assembly 201 through the first connector 221. The second driving assembly 202 may transmit the calibration data stored in the memory 232 to the timing controller 173 based on the first and second signals being 1 and 0.

As illustrated in FIG. 7, in the second connector 222 of the second driving assembly 202, the second pin of the 3 pins may be connected to the first connector 221 of the third driving assembly 203, and the third pin may be connected to the ground. Therefore, 0, 0, and 0 may be transmitted to the third driving assembly 203 through the second connector 222 of the second driving assembly 202.

The third driving assembly 203 does not transmit the calibration data stored in the memory 233 based on the first control signal of 0 and 0.

Referring to FIG. 9, in order to select the first driving assembly 202, the timing controller 173 may transmit the first control signal of 1, 0, and 0 through 3 pins of 51 pins. The first driving assembly 201 may transmit the calibration data stored in the memory 231 to the timing controller 173 based on the first and second signals being 1 and 0.

Like FIG. 7, in the second connector 222 of the first driving assembly 201, the second pin of the 3 pins may be connected to the first connector 221 of the second driving assembly 202, and the third pin may be connected to the ground. Therefore, the second connector 222 of the first driving assembly 201 may transmit 0, 0, and 0 to the second driving assembly 202. The second driving assembly 202 does not transmit the calibration data stored in the memory 232 based on the first control signal of 0 and 0.

As illustrated in FIG. 7, in the second connector 222 of the second driving assembly 202, the second pin of the 3 pins may be connected to the first connector 221 of the third driving assembly 203, and the third pin may be connected to the ground. Therefore, the second connector 222 of the second driving assembly 202 may transmit 0, 0, and 0 to the third driving assembly 203. The third driving assembly 203 does not transmit the calibration data stored in the memory 233 based on the first control signal of 0 and 0.

Meanwhile, a method of allocating the first control signal to the pin map by the timing controller 173 or a reference of the signal for selecting the LED module may be variously changed. For example, when the display apparatus 10 is connected to four or more LED modules 100 through the cable 220, the signal for selecting the LED module 100 through the first control signal different from FIGS. 7 to 9 may also be transmitted.

Figure 10:
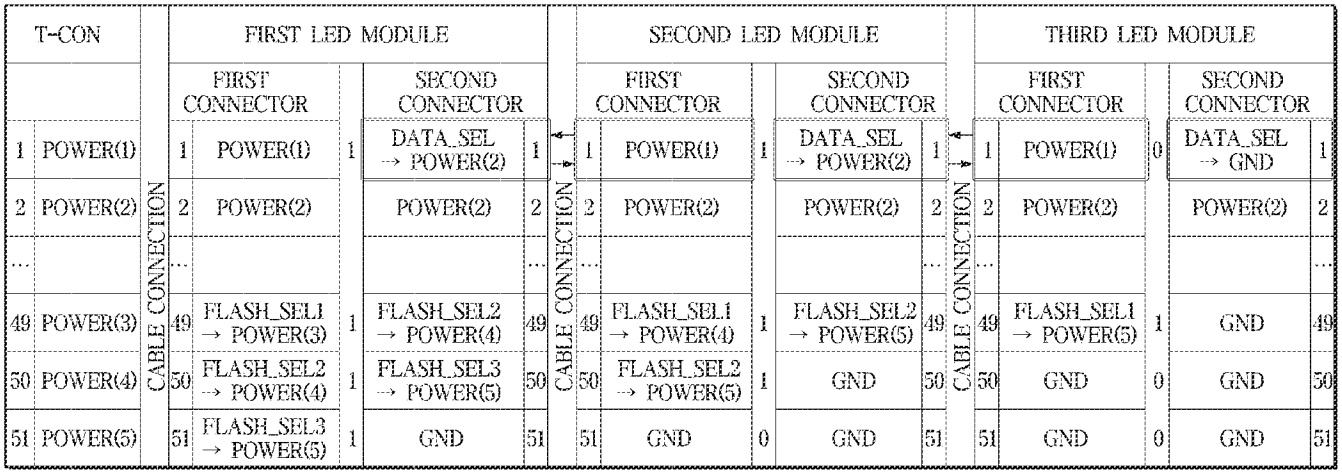
Figure 11:
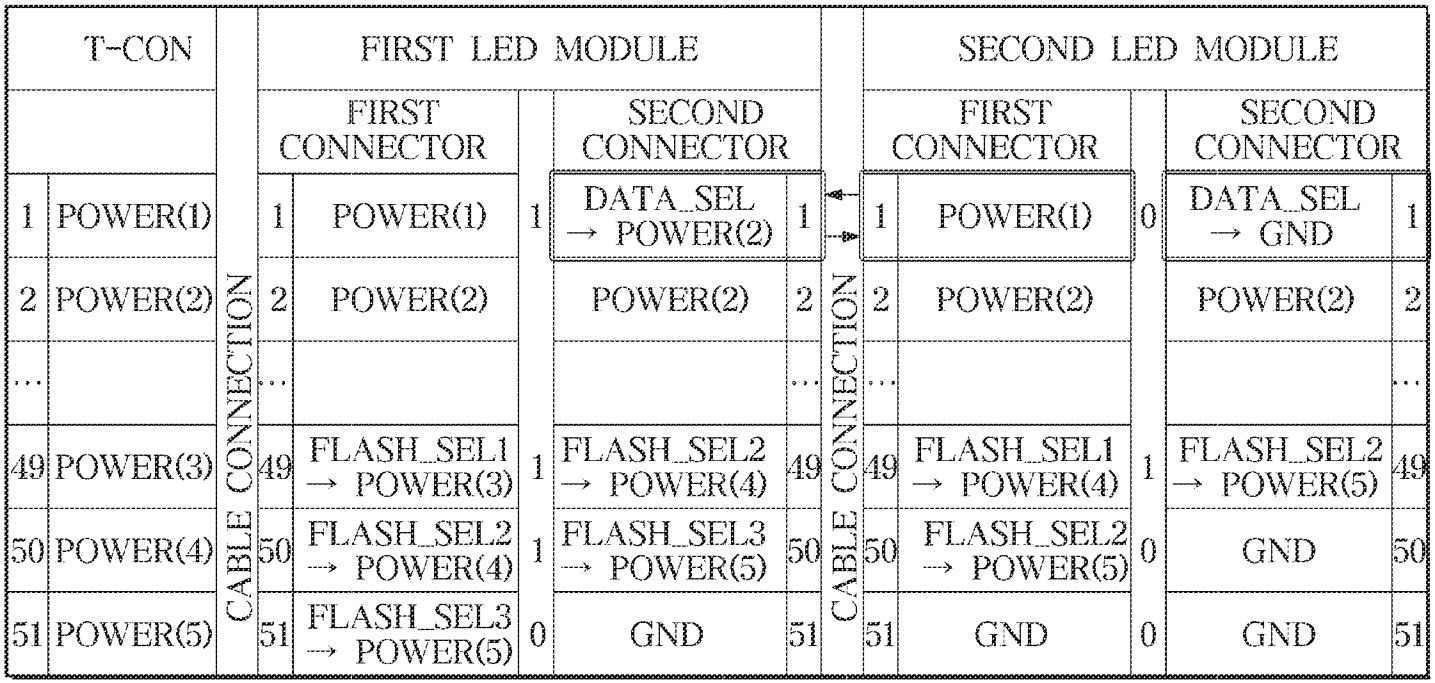

FIGS. 10 to 12 are views of a pin map for describing a second control signal. It will be described together below in order to avoid redundant description.

The display apparatus 10 may connect the timing controller 173, the first LED module 101, the second LED module 102, and the third LED module 103 as shown in the figures.

The timing controller 173, the first LED module 101, the second LED module 102, and the third LED module 103 may connect to each driving assembly 201, 202, and 203 through the cables 225 and 226 composed of 51 pins and the connector 221 and 222 into which the cables 225 and 227 are inserted.

Referring to FIG. 10, the timing controller 173 may allocate the first control signal for selecting the first LED module 101, the second LED module 102, and the third LED module 103 at pins 49, 50, and 51. That is, FLASH_SEL 1, FLASH_SEL 2 and FLASH_SEL 3 illustrated in FIG. 10 denote the first control signal allocated to the pin map.

Meanwhile, the timing controller 173 may allocate the second control signal to pin 1 of 51 pin maps as DATA_SEL. That is, the first driving assembly 201 may select whether to transmit the first control signal or the image data to the second driving assembly 202 based on the second control signal.

Particularly, the first driving assembly 201 of the first LED module 101 may receive the first control signal, the second control signal, and the image data from the timing controller 173. The plurality of driving ICs 210 provided in the first driving assembly 201 may be driven based on image data. Each of the plurality of driving ICs 210 provided in the first driving assembly 201 may transmit the image data and the control signals (the first control signal and the second control signal) in a cascade form. Here, the last driving IC among the plurality of driving ICs 210 provided in the first driving assembly 201 may change the second control signal to 1 or 0. In the embodiment of FIG. 10, since the first cable 225 is connected to the second connector 222, the last driving IC of the first driving assembly 201 may change the second control signal to 1, that is, pull-up.

The second LED module 102 may be connected to the third LED module 103. Accordingly, the second connector 222 of the second driving assembly 202 may be connected to the third driving assembly 203 through the second cable 227. The second driving assembly 202 may also transmit the second control signal connected from the first driving assembly 201 to the third driving assembly 203 while pulling-up.

The second connector 222 of the third driving assembly 203 is not connected with an additional cable. Therefore, the third driving assembly 203 may pull-down the second control signal to zero.

Based on the pull-down signal, the third driving assembly 203 may transmit the feedback signal to the timing controller 173. The feedback signal may be allocated to another pin, for example, pin 2 to which the first control signal and the second control signal are not allocated. In addition, according to the embodiment, when the third driving assembly 203 transmits the calibration data to the timing controller 173, the calibration data may be inserted into pins 3 to 48.

Referring to FIG. 11, the display apparatus 10 may connect to the timing controller 173, the first LED module 101, and the second LED module 102.

The timing controller 173 may allocate the second control signal to the first pin.

The first driving assembly 201 of the first LED module 101 may receive the first control signal, the second control signal, and the image data. The second connector 222 of the first driving assembly 201 may be connected to the second driving assembly 202 through the cable 225. Based on this connection state, the first driving assembly 201 may change the second control signal to 1. The first driving assembly 201 may transmit a signal including a pull-up signal and the control signal to the second driving assembly 202.

The second connector 222 of the second driving assembly 202 is not connected with the additional cable. Accordingly, the second driving assembly 202 may pull-down the second control signal to zero. In addition, when pulled down to 0, the second driving assembly 202 may transmit the feedback signal to the first driving assembly 201.

Referring to FIG. 12, the display apparatus 10 may not have an additional LED module 100 connected to the first LED module 101. The first driving assembly 201 may pull-down the signal to 0 to the first pin and transmit the feedback signal. The timing controller 173 may confirm that the additional LED module is not connected to the first LED module 101 through this.

Meanwhile, the pin maps illustrated in FIGS. 10 to 12 are only an example. Therefore, the second control signal is not necessarily allocated to pin 1, but may be allocated to a plurality of pins.

Figure 13:
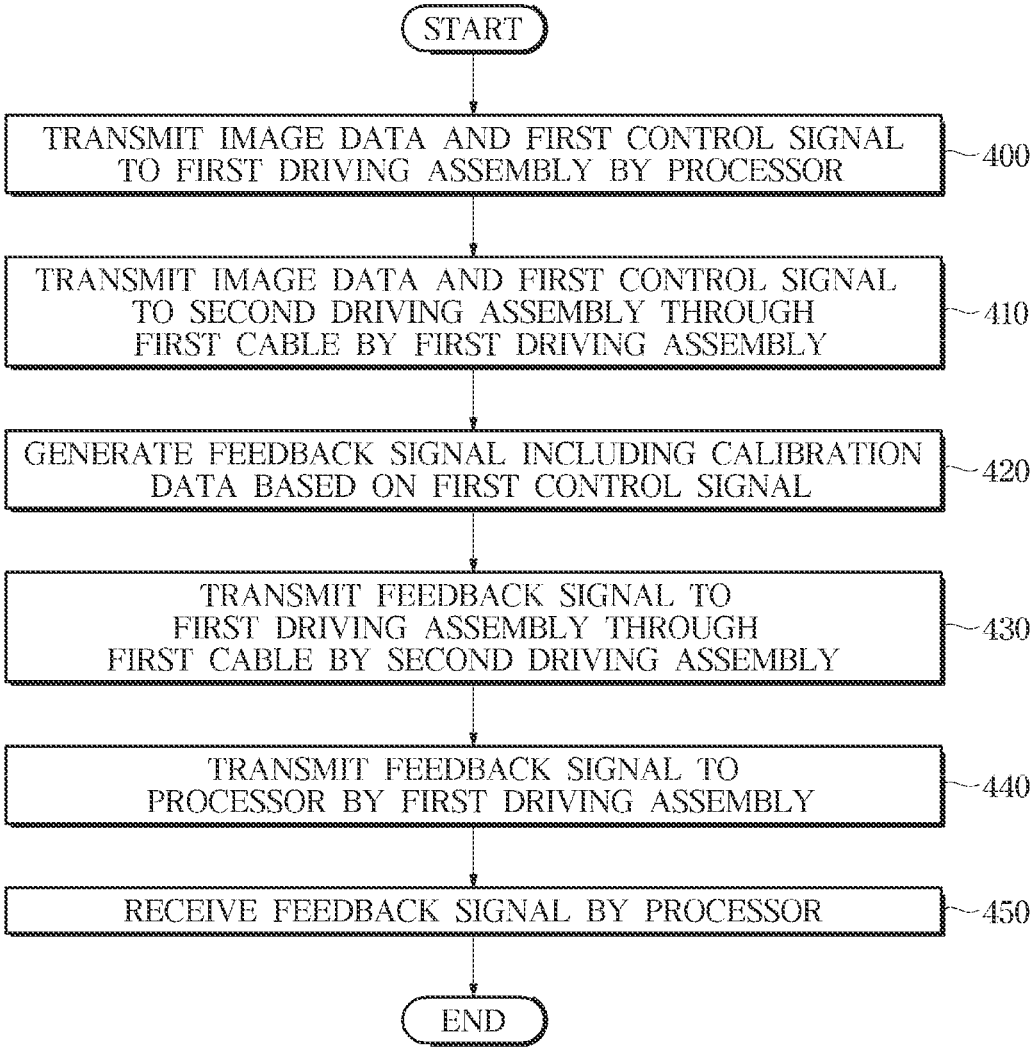
FIG. 13 is a flowchart illustrating operations of a display apparatus according to an embodiment.

FIG. 13 is a flowchart illustrating operations of a display apparatus according to an embodiment.

Referring to FIG. 13, in the display apparatus 10, the first driving assembly 201 of the first LED module 101 and the second driving assembly 202 of the second LED module 102 may be connected through the connector 220 and the first cable 225.

The processor 171, for example, the timing controller 173 may transmit the image data and the first control signal to the first driving assembly 201 (400).

Here, the first control signal is a selection signal for receiving the calibration data of the first driving assembly 201 or the second driving assembly 201.

The first driving assembly 201 may transmit the image data and the first control signal to the second driving assembly 202 through the first cable 225 (410).

Particularly, the first driving assembly 201 does not insert the calibration data stored in the first memory 231 based on the first control signal including the selection signal of the second LED module 102.

The second driving assembly 202 may generate the feedback signal including the calibration data based on the first control signal (420).

Particularly, the feedback signal is a signal in which data insertion or data change is performed according to the first control signal transmitted from the first driving assembly 202 is retransmitted again through the first cable 225.

The second driving assembly 202 may transmit the feedback signal to the first driving assembly through the first cable 225 (430), and the first driving assembly 201 may transmit the feedback signal to the processor 171 (440).

The processor 171 may receive the feedback signal (450).

The processor 171 may perform image processing based on the calibration data of the second LED module 102 included in the feedback signal, and output the image according to each LED module 100, thereby reducing a sense of heterogeneity, such as a difference in contrast, felt by the user.

Figure 14:
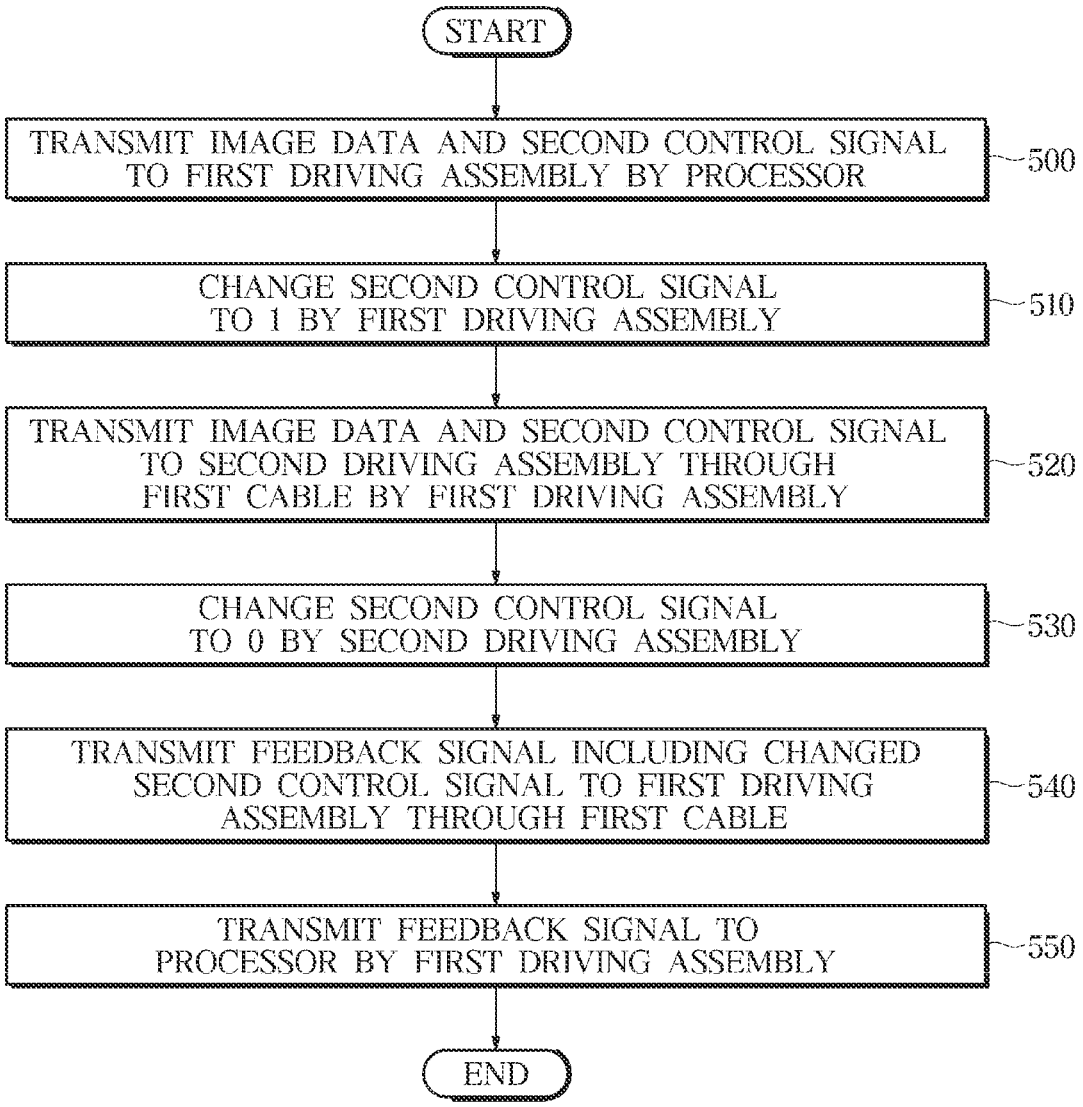
FIG. 14 is a flowchart illustrating operations of a display apparatus according to an embodiment.

FIG. 14 is a flowchart illustrating operations of a display apparatus according to an embodiment.

Like FIG. 14, in the display apparatus 10, the first driving assembly 201 of the first LED module 101 and the second driving assembly 202 of the second LED module 102 may be connected through the connector 220 and the first cable 225.

The processor 171 may transmit the image data and the second control signal to the first driving assembly 201 (500), and the first driving assembly 201 may change the second control signal to 1 (510).

When the second connector 222 of the first driving assembly 201 is connected through the first cable 225, at least one driving IC of the first driving assembly 201 may pull up a part of the second control signal.

The first driving assembly 201 may transmit the image data and the second control signal to the second driving assembly 202 through the first cable 225 (520).

Here, the second control signal may include the pull-up signal.

The second driving assembly 202 may change the second control signal to 0 (530).

The second connector 222 of the second driving assembly 202 may not be connected to the additional cable 225. At least one driving IC of the second driving assembly 202 may pull up a part of the control signal.

The second driving assembly 202 may transmit the feedback signal including the changed second control signal to the first driving assembly 201 through the first cable 225 (540), and the first driving assembly 201 may transmit the feedback signal to the processor 171 (550).

According to the display apparatus and the method of controlling the display apparatus according to the embodiments, it is possible to improve power efficiency and operating efficiency of the driving IC, and control the plurality of LED modules by one main board controlling at least two LED modules.

Embodiments of the disclosure have thus far been described with reference to the accompanying drawings. It should be obvious to a person of ordinary skill in the art that the disclosure may be practiced in other forms than the embodiments as described above without changing the technical idea or essential features of the disclosure. The above embodiments are only by way of example, and should not be interpreted in a limited sense.

What is claimed is:

1. A display apparatus comprising:

a first light emitting diode (LED) module comprising a first driving assembly;

a second LED module comprising a second driving assembly;

a connector configured to connect the first driving assembly to the second driving assembly; and a processor connected to the first driving assembly, wherein the processor is configured to transmit image data and a control signal to the first driving assembly, wherein the first driving assembly is configured to operate based on the image data, and to transmit the image data and the control signal to the second driving assembly through the connector, wherein the second driving assembly comprises a first connector connected to the first driving assembly through a first cable and a second connector connected to a third driving assembly through a second cable, and wherein the second driving assembly is configured to transmit a feedback signal based on the control signal, and change the feedback signal based on a connection state of the second connector and the second cable.

2. The display apparatus according to claim 1, wherein the second driving assembly is configured to operate based on the image data received through the connector, and to transmit the feedback signal based on the control signal to the processor through the connector.

3. The display apparatus according to claim 1, wherein the control signal comprises a signal for selecting the second LED module, and wherein the processor is configured to transmit the control signal for selecting the second LED module through the connector.

4. The display apparatus according to claim 3, wherein each of the first driving assembly and the second driving assembly comprises a memory configured to store calibration data for a plurality of LEDs, and wherein the first driving assembly is configured to transmit the control signal to the second driving assembly.

5. The display apparatus according to claim 4, wherein the second driving assembly is configured to transmit the calibration data in the feedback signal based on the control signal.

6. The display apparatus according to claim 1, wherein the first connector comprises a first plurality of pins and the second connector comprises a second plurality of pins, wherein at least one of the first plurality of pins is in electrical contact with at least one of the second plurality of pins; and wherein the processor is configured to transmit the control signal based on at least three pins among the first plurality of pins and the second plurality of pins.

7. The display apparatus according to claim 6, wherein the second connector comprises at least one pin connected to a ground.

8. The display apparatus according to claim 1, wherein each of the first driving assembly and the second driving assembly comprises a plurality of driving integrated circuits (ICs) configured to control a predetermined number of LEDs; and wherein the plurality of driving ICs are configured to operate based on the image data.

9. The display apparatus according to claim 8, wherein each of the first LED module and the second LED module comprises a respective switching mode power supply (SMPS) configured to supply power to the first driving assembly and the second driving assembly, respectively.

10. A method of controlling a display apparatus, the display apparatus including a first light emitting diode (LED) module including a first driving assembly, a second LED module including a second driving assembly, a cable configured to connect the first driving assembly to the second driving assembly, and a processor connected to the first driving assembly, the method comprising:

transmitting, by the processor, image data and a control signal to the first driving assembly;

transmitting, by the first driving assembly, the image data and the control signal to the second driving assembly through the cable; and transmitting, by the second driving assembly, a feedback signal based on the control signal to the first driving assembly through the cable, wherein the second driving assembly comprises a first connector connected to the first driving assembly through a first cable and a second connector connected to a third driving assembly through a second cable, and wherein the transmitting by the second driving assembly comprises changing the feedback signal based on a connection state of the second connector and the second cable.

11. The method according to claim 10, wherein the control signal comprises a signal for selecting the second driving assembly.

12. The method according to claim 10, wherein each of the first driving assembly and the second driving assembly comprises a memory configured to store calibration data for a plurality of LEDs; and the transmitting by the second driving assembly comprises transmitting the calibration data in the feedback signal based on the control signal.

13. The method according to claim 10, wherein the transmitting by the first driving assembly comprises transmitting the image data and the control signal through the first connector.

14. The method according to claim 13, wherein the cable comprises a plurality of pins in electrical contact with the first connector of the second driving assembly, and wherein transmitting by the processor comprises transmitting the control signal to the third driving assembly using at least three pins among the plurality of pins.

15. The method according to claim 14, wherein the second connector has at least one pin connected to a ground, and wherein the transmitting by the first driving assembly comprises transmitting a ground signal through the at least one pin to the second driving assembly.

* * * * *